US007517115B2

(12) United States Patent
Van De Poel

(10) Patent No.: US 7,517,115 B2
(45) Date of Patent: Apr. 14, 2009

(54) REFLECTOR LAMP

(75) Inventor: Gunther Van De Poel, Kortenaken (BE)

(73) Assignee: Flowil International Lighting (Holding) B.V., Amsterdam (NL)

( * ) Notice: Subject to any disclaimer, the term of this patent is extended or adjusted under 35 U.S.C. 154(b) by 655 days.

(21) Appl. No.: 11/226,851

(22) Filed: Sep. 14, 2005

(65) Prior Publication Data

US 2006/0083006 A1 Apr. 20, 2006

(30) Foreign Application Priority Data

Sep. 14, 2004 (EP) ..... 04021799

(51) Int. Cl.
*F21V 7/00* (2006.01)

(52) U.S. Cl. ..... 362/297; 362/346; 362/348; 362/350; 362/347

(58) Field of Classification Search ..... 362/297
See application file for complete search history.

(56) References Cited

U.S. PATENT DOCUMENTS 4,864,180 A 9/1989 English et al.
5,952,768 A 9/1999 Strok et al.
6,252,338 B1 6/2001 Bergman et al.

FOREIGN PATENT DOCUMENTS

EP 1 076 203 A2 2/2001

*Primary Examiner*—Anabel M Ton
(74) *Attorney, Agent, or Firm*—Brooks Kushman P.C.

(57) ABSTRACT

A reflector lamp having a concave reflector with a base at one end and a lens at an opposite end. A discharge lamp having a fill of or forming salts maintained by heat in a vapor phase is located near the base end of the reflector. When the reflector lamp is oriented in a near-horizontal position, the fill coming into contact with a colder, lower side of the discharge lamp partially condenses, coloring light passing through the condensate. At least two interior reflector surface areas, which have contours defined by rotating generatrices with configurations of conic section lines, reflect the colored light to distribute it evenly over a surface being illuminated and avoid creating a hot spot.

14 Claims, 4 Drawing Sheets

REFLECTOR LAMP

BACKGROUND OF THE INVENTION

1. Field of the Invention

This invention relates generally to lamps having concave reflectors and particularly to discharge lamps having compound, concave reflectors.

2. Background Art

Lamps having one or more concave reflectors to reflect light from a small source along a longitudinal axis are known in the art. A reflector lamp of this general structure has been disclosed, for example, in European Patent EP 1 076 203 A2 to Lieszkovszky. The reflector lamp disclosed includes a first surface area having a paraboloid, an ellipsoid or a spheroid configuration and a second surface area having a paraboloid configuration. The second surface area has a fluted configuration, and the surface areas distribute light to minimize centralized hot spot effects and to direct light in a near-parallel manner along a longitudinal axis within a light cone preferably having a maximum apex angle of 5 degrees.

Similar reflector lamps that use a discharge lamp for a light source have a disadvantage, however. When such a lamp is disposed in near-horizontal orientations, a portion of emitted light passes through a typically yellow condensate formed of vapor condensed near a colder, low side within the discharge lamp. The condensate absorbs blue light, and the remaining emitted light is predominantly yellow. Since the yellow light is not radiated evenly about the longitudinal axis, it will not be distributed evenly across a surface being illuminated.

SUMMARY OF THE INVENTION

An object of the present invention is to provide an improved reflector lamp that minimizes the demixing of colors and maximizes the even color distribution of light over a surface being illuminated.

In carrying out the foregoing object, the reflector lamp of the present invention has a longitudinal axis and includes a concave reflector having a base disposed at one end and a lens disposed at an opposite end. A discharge lamp having a discharge chamber is disposed on the longitudinal axis within the concave reflector. The discharge lamp has a fill comprising or forming salts, which, in the heat of the discharge lamp, are maintained in a vapor phase. When the longitudinal axis is deviated from an upright position, however, and especially when the longitudinal axis is essentially in a horizontal position, the fill at least partially condenses from the vapor phase to a liquid phase condensate as the vapor contacts a colder, lower side of the discharge chamber.

The concave reflector has a reflective surface including at least two differently curved surface areas. A first surface area extends away from the base, and a second surface area extends from the first surface area in a direction toward the lens. At least the first and second surface areas each have a different contour defined by a rotating generatrix having a configuration of a selected conic section line. The contours of the surface areas include paraboloids, ellipsoids and frustrated cone surfaces; and the disposition of the center of light emission of the discharge lamp in relation to the surface areas are such that light from the discharge lamp passing through and being colored by the condensate is reflected at different points of the reflector areas in different directions and is thus distributed evenly over a surface being illuminated.

In different embodiments of the present invention, the surface areas number two or more and include variously configured facets; and their focal points are disposed at specific locations along the longitudinal axis.

The features and advantages of the invention are described in greater detail in the following with reference to the drawing figures.

DETAILED DESCRIPTION OF THE PREFERRED EMBODIMENTS

Figure 1:
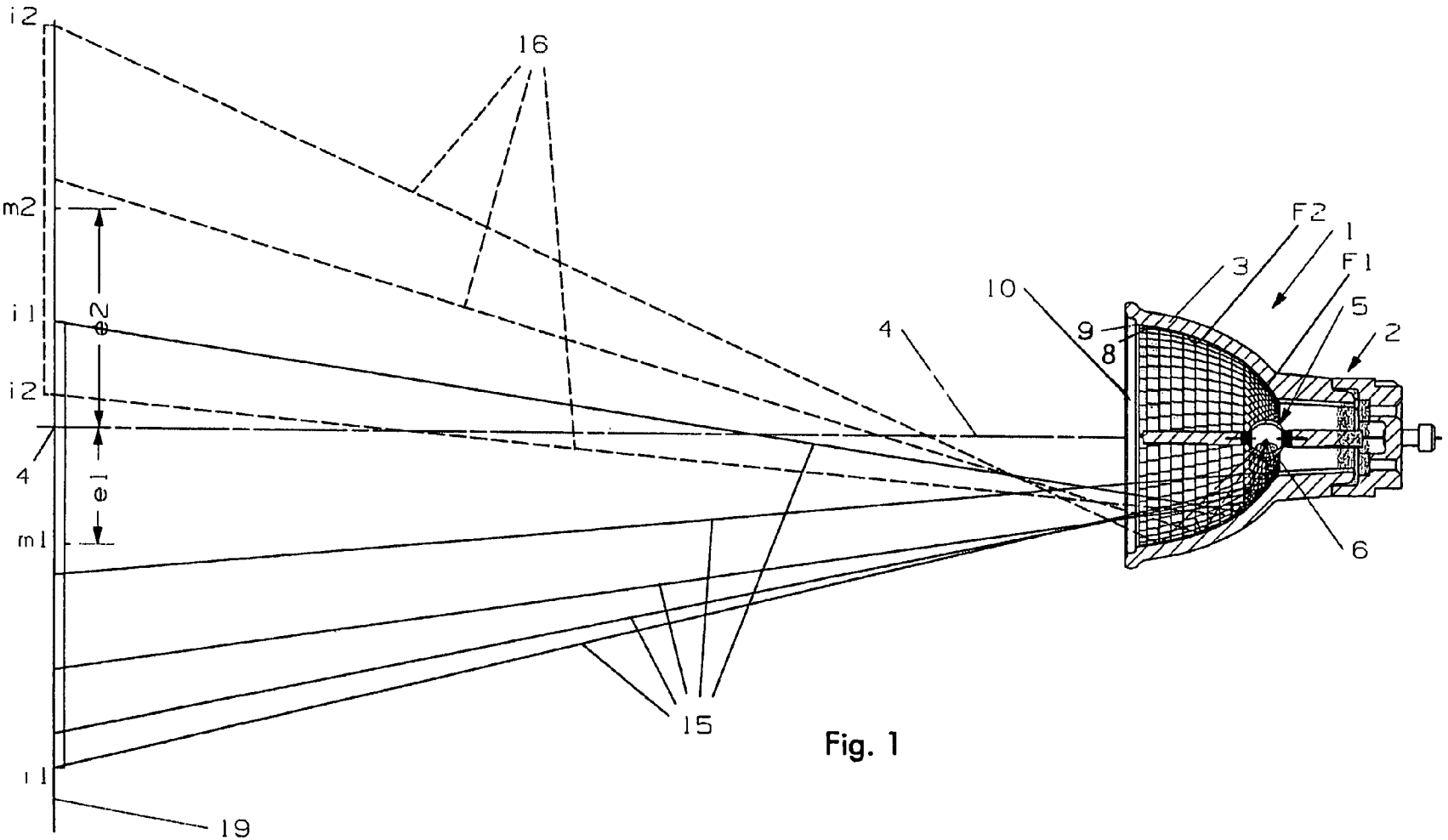
FIG. 1 is a longitudinally sectioned side view of a first preferred embodiment of a reflector lamp in accordance with the present invention and shows representative paths of emitted and reflected light.
Figure 2:
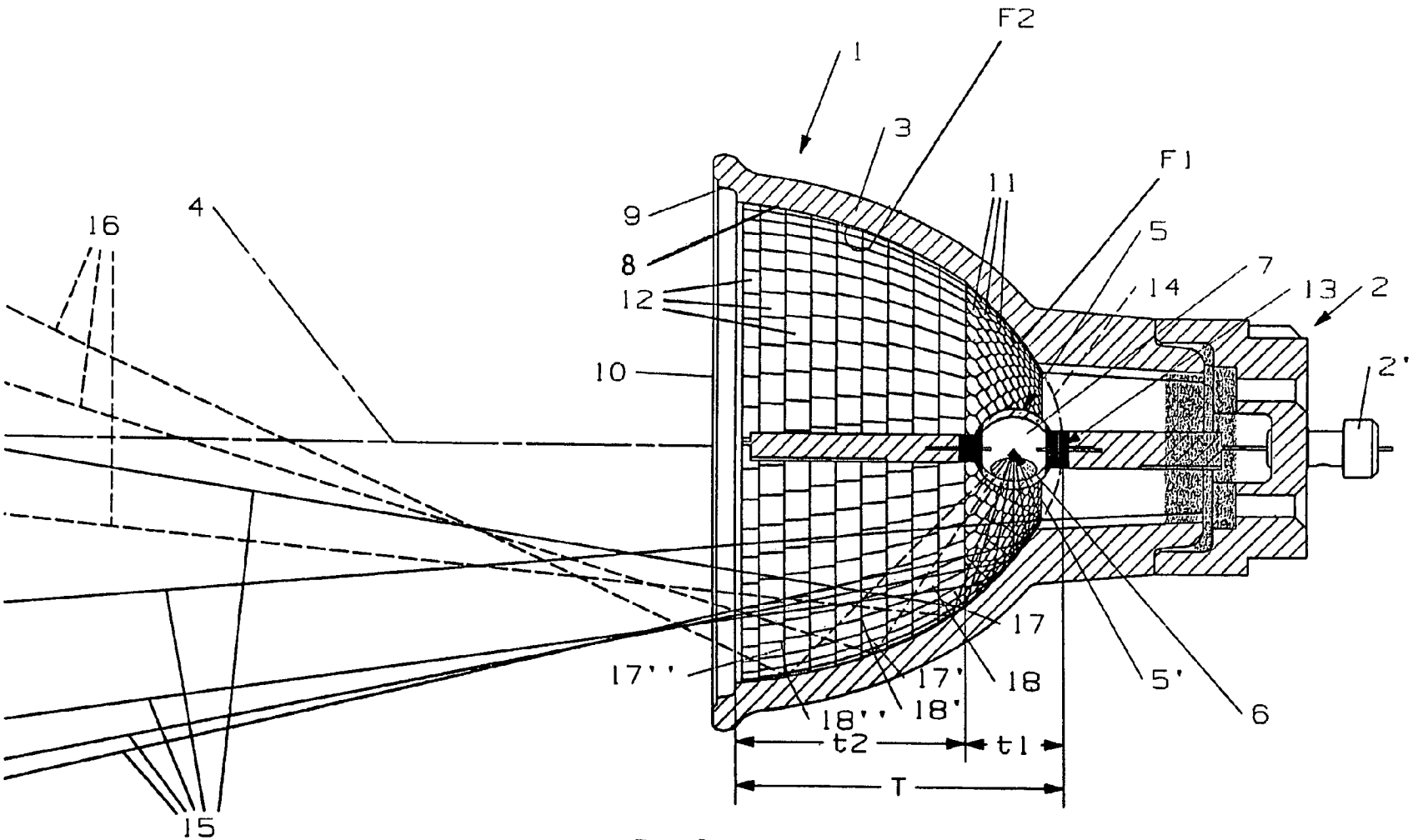
FIG. 2 is an enlarged view of the reflector lamp of FIG. 1.

As shown by FIGS. 1 and 2, a first preferred embodiment of the invention concerns a reflector lamp 1 having a longitudinal axis 4. The reflector lamp 1 includes a concave reflector 3 having a base 2 disposed at one end and a lens 10 disposed at an opposite end. A discharge lamp 5 having a discharge chamber 7 is disposed on the longitudinal axis 4 within the concave reflector 3. In the embodiment shown, the discharge lamp 5 is a halide metal vapor discharge lamp 5 with electrical leads that are connected to terminals 2' at the base 2. Light emitted from the discharge lamp 5 is reflected by the reflector 3 toward a surface 19 being illuminated. If all light being reflected is of uniform color, it will be distributed with even intensity over the surface 19 being illuminated.

The discharge lamp 5, however, has a fill comprising or forming salts, which, in the heat of the discharge lamp 5, are at least partially in a vapor phase. Proximate a lower and cooler side of the discharge chamber 7, a portion of the vapor condenses from a vapor phase to a liquid phase, forming a condensate 6. When the longitudinal axis 4 of such a discharge lamp 1 is oriented at an angle to the horizontal, particularly at an angle between 0 and 45 degrees, and especially when it is oriented essentially horizontally, light radiating downwardly passes through the condensate 6. Typically, the condensate 6 is yellow and absorbs blue light, passing yellow light to reflect from a portion of the reflector 3 and continue, as along illustrated paths 15, which are essentially parallel to the longitudinal axis 4.

Generally, the more surface areas used in a reflector, the more uniformly distributed is the yellow light. Accordingly, four or more surface areas could theoretically be used. As a matter of practicality, however, fabricating a reflector having more than three surface areas becomes prohibitively costly. Experience has shown that especially good distribution, or no demixing, of the yellow light is obtained, even with only two or three surface areas, if the first surface area is provided with spherical facets disposed in a honeycomb-like structure. Even more advantage is to be gained by providing the second surface area with one set of a set of flat spirals and a set of cylindrical facets, which do not scatter light as much as do spherical facets.

The center of light emission 5' of the discharge lamp 5 which is assumed to be in the middle of the discharge chamber 7, is located here between the focal point (not shown) of the first surface area F1 and the base 2 of the reflector 3, whereas the focal point (not shown) of the second surface area F2 is displaced closer to the lens 10 than is the focal point of the first surface area F1. In such an arrangement the path of light has proved to be particularly favorable.

If the reflector 3 has only one surface area F1, a portion of the surface 19 being illuminated by light passing through the yellow condensate 6 will have an undesirable yellow color. If, however, the reflector 3 has appropriate first and second surface areas F1 and F2, with the surface area F2 closer to the lens 10 than is the surface area F1, a portion of light passing through the yellow condensate 6 is reflected from the second surface area F2 and continues, as along illustrated paths 16, which are more divergent from the longitudinal axis 4 and which distribute yellow light evenly over the remaining surface 19 being illuminated.

Accordingly, the concave reflector 3 of the first preferred embodiment of the present invention has two surface areas. A first surface area F1 extends from the base 2, and a second surface area F2 extends from the first surface area F1 in a direction toward the lens 10. The first and second surface areas F1 and F2, respectively, each have a different contour defined by a rotating generatrix having a configuration of a selected conic section line. The contours of both surface areas are selected from configurations that include paraboloids, ellipsoids, spherical surfaces and frustrated cone surfaces. In the first preferred embodiment, as shown by FIGS. 1 and 2, the first surface area F1 of the reflector 3 has a configuration of a paraboloid; and the second surface area F2 has a configuration of an ellipsoid.

FIG. 2 illustrates the second principle of reflection of light, namely, that the angle of incidence is equal to the angle of reflection. These angles are traditionally held to be the angles between the incident and reflected light paths and normals 17, 17' and 17" to the reflector surface at points of coincidence 18, 18' and 18"; but the principle, of course, applies equally if the angles are taken between incident and reflected light paths and tangents, rather than normals, to the curved reflector surface at points of coincidence. The same principle applies to light following illustrated paths 15.

FIG. 1 illustrates the areas covered by light arriving along illustrated paths 15 and 16 and impinging on the surface 19 being illuminated. The longitudinal axis 4 of the reflector 3 intersects the surface 19 being illuminated at a point 4', which is the center of illumination. Predominantly yellow light radiating along paths 15 from the first surface area F1 is shown illuminating an area indicated in cross-section by end points i1, i1 and a center point m1. The area includes the lower region of the surface 19 being illuminated and extends upwardly beyond the center of illumination point 4'. The center point m1 is displaced downwardly relative to the center of illumination point 4' by a distance indicated by e1.

Light radiating along paths 16 from the second surface area F2 is shown illuminating an area indicated in cross-section by end points i2, i2 and a center point m2. The area includes the upper region of the surface 19 being illuminated and extends downwardly almost to the center of illumination point 4'. The center point m2 is displaced upwardly relative to the center of illumination point 4' by a distance indicated by e2.

As shown, light radiating along paths 15 and 16 each impinge on separate but somewhat overlapping portions of the surface 19 being illuminated. Consequently, the total amount of light radiating along paths 15 and 16 and along all other paths of light emitted by the discharge lamp 5 is evenly distributed with other light radiating from the reflector lamp 1 over the surface 19 being illuminated. Thus, color demixing, with an attendant yellow hot spot on the surface 19 being illuminated, is avoided.

FIG. 2 indicates relative distances between elements along the longitudinal axis 4. The distance between a projected apex 13 and a proximate edge of the first surface area F1 is indicated by t1, and the distance between a distal edge of the first surface area F1 and a distal edge of the second surface area F2 is indicated by t2. The combined distances t1 and t2 is indicated by T.

The depth of the first surface area F1 of the reflector lamp 1 shown by FIG. 2 is 125 percent of the maximum length of the discharge chamber 7 of the discharge lamp 5 and is thus dependent on the length of the discharge chamber 7. It is also dependent on the position of the discharge lamp 5 and its center of light emission 5'.

For example, as the depth t1 is increased, the portion of yellow light reflected by the first surface area F1 also increases, thereby increasing the portion of yellow light reflected downwardly. This would result in a decrease in the amount of yellow light impinging on the second surface area F2 to be reflected upwardly. An undesirable concentration of yellow light in the lower region of the surface 19 being illuminated would result.

In a manufactured example of a reflector lamp 1 in accordance with the first preferred embodiment of the present invention and having a diameter of 50 mm and two surface areas, the depth of the reflector 3 is about 28 mm. The depth of the first surface area F1, measured from its projected apex 13, is about 8.5 mm; and the depth of its bordering second surface area F2 is about 19.5 mm. The center of light emission 5' of the discharge lamp 5 is about 4.3 mm from the projected apex 13 and is thereby located about in the center of the first surface area F1. The focal point of the first surface area is about 5.8 mm from the projected apex 13.

As shown in FIGS. 1 and 2, there is a surface area 14 between the apex 13 of the reflector 3 and the first surface area F1. Due to the interfering proximity of the base 2 and the discharge chamber 7, the light contribution of the surface area 14 to overall light reflection of the reflector 3 is negligible.

Figure 3:
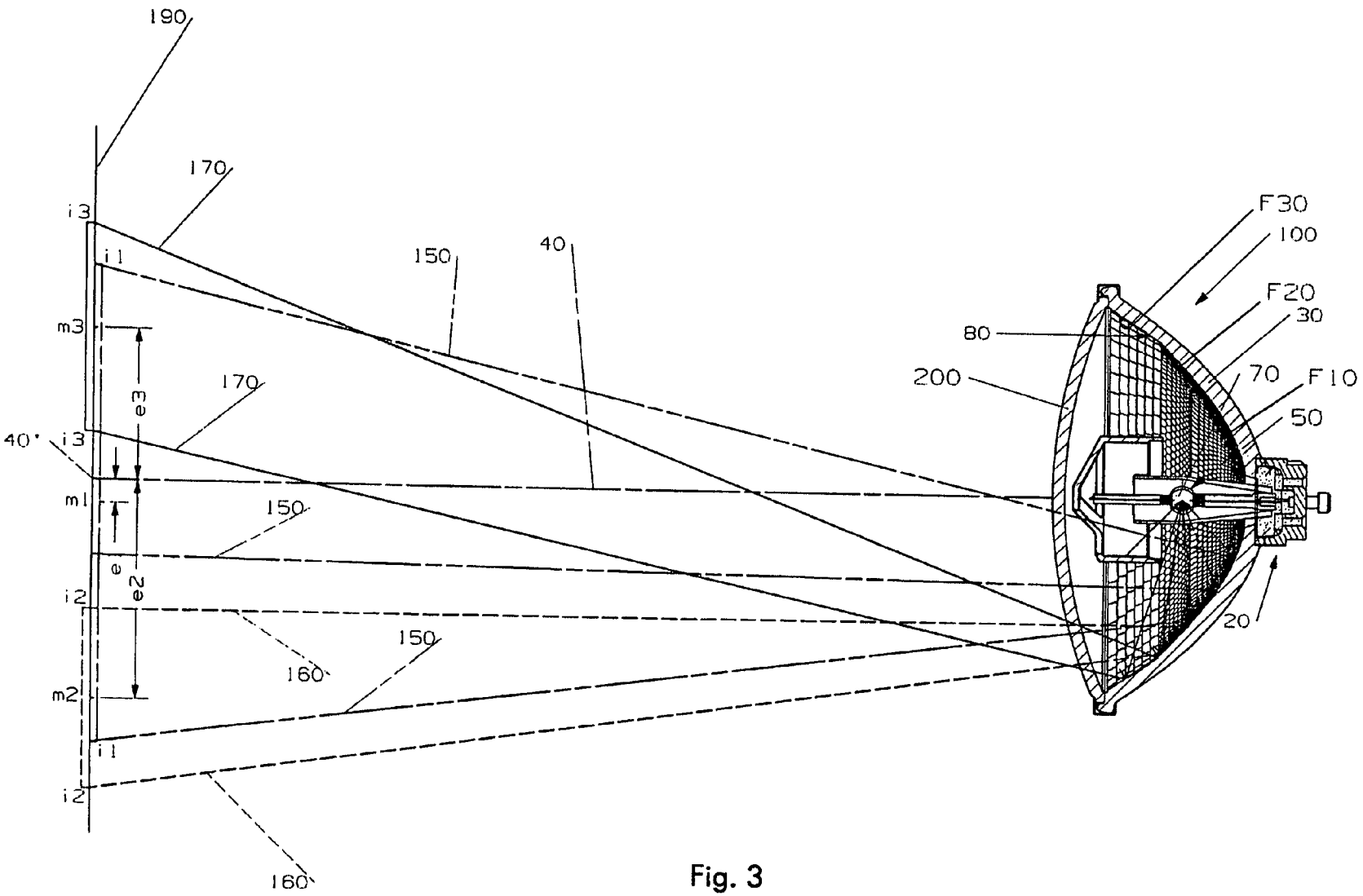
FIG. 3 is a longitudinally sectioned side view of a second preferred embodiment of a reflector lamp in accordance with the present invention and shows representative paths of emitted and reflected light.
Figure 4:
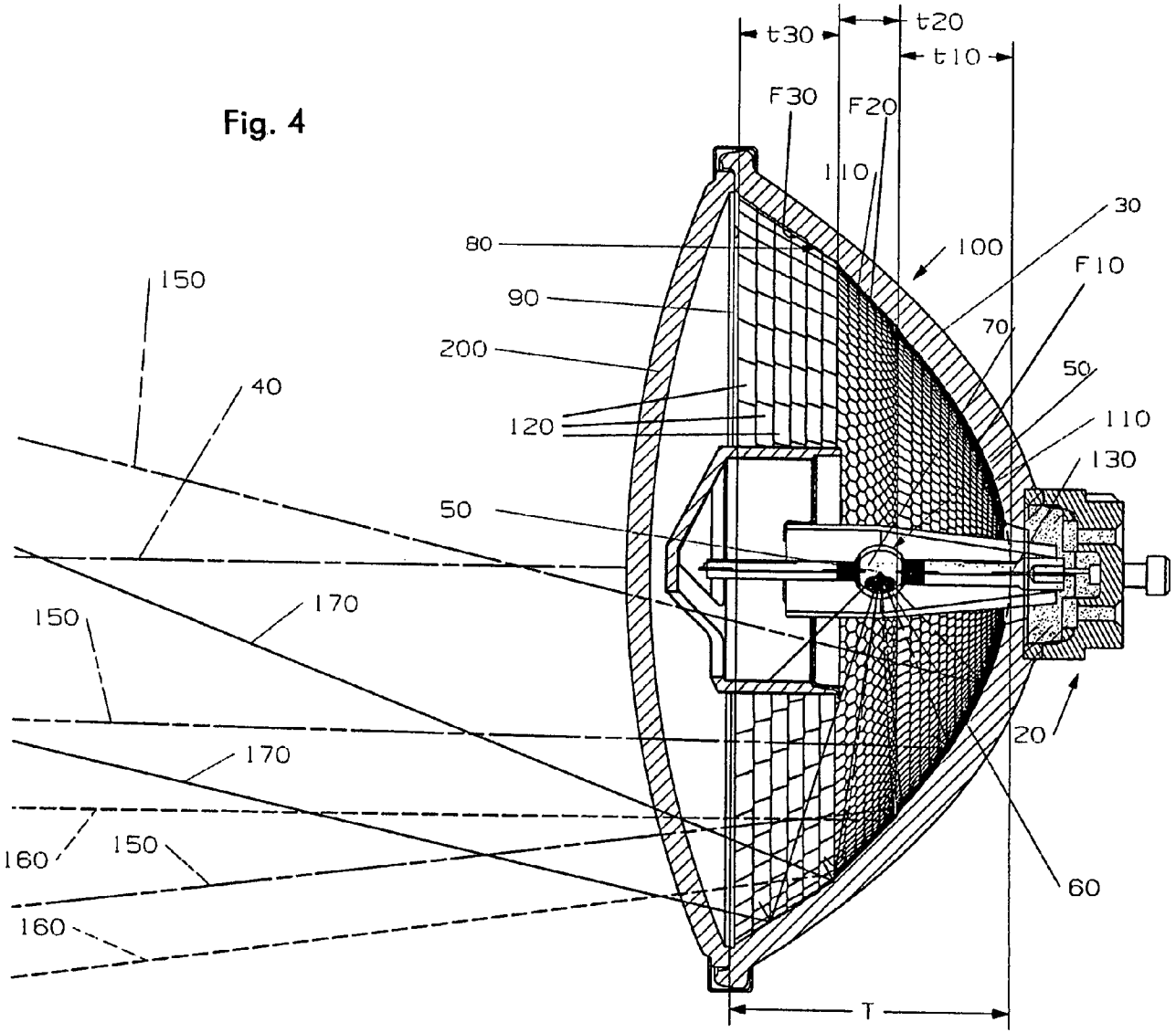
FIG. 4 is an enlarged view of the reflector lamp of FIG. 3.

A second preferred embodiment of a reflector lamp 100 of the present invention is shown by FIGS. 3 and 4. It has a longitudinal axis 40 and includes a concave reflector 30 having a base 20 disposed at one end and a lens 200 disposed at an opposite end. A discharge lamp 50 having a discharge chamber 70 is disposed on the longitudinal axis 40 within the concave reflector 30. Light emitted from the discharge lamp 50 is reflected by the reflector 30 toward a surface 190 being illuminated. As in the first preferred embodiment, if all light being reflected is of uniform color, it will be distributed with even intensity over the surface 190 being illuminated.

Also, as in the first preferred embodiment, the discharge lamp 50, has a fill comprising or forming salts, which, in the heat of the discharge lamp 50, are at least partially in a vapor phase. Proximate a lower and cooler side of the discharge chamber 70, a portion of the vapor sublimates from a vapor phase to a solid phase, forming a condensate 60. When the longitudinal axis 40 of such a discharge lamp 100 is oriented at an angle to the horizontal, particularly at an angle between 0 and 45 degrees, and especially when it is oriented essentially horizontally, light radiating downwardly passes through the condensate 60. Typically, the condensate 60 is yellow and absorbs blue light, passing yellow light to reflect from a portion of the reflector 30 and continue, as along illustrated paths 150.

If the reflector 30 has only one surface area F10, a portion of the surface 190 being illuminated by light passing through the yellow condensate 60 will have an undesirable yellow color. If, however, the reflector 30 also has appropriate second and third surface areas F20 and F30, respectively, with the surface area F20 being closer and the surface area F30 being even closer to the lens 200 than is the surface area F10, a portion of light passing through the yellow condensate 60 is reflected from the second surface area F20 and continues, as along illustrated paths 160, which are more divergent from the longitudinal axis 40 and which distribute yellow light evenly over the remaining surface 190 being illuminated. This results in a more even distribution of yellow light over the entire surface 19.

Accordingly, the concave reflector 30 of the second preferred invention has three surface areas. A first surface area F10 extends from the base 20, a second surface area F20 extends from the first surface area F10, and a third surface area F30 extends from the second surface area F20 in a direction toward the lens 200. As in the first preferred embodiment, the surface areas each have contours defined by a rotating generatrix having a configuration of a selected conic section line. The contours of the surface areas are selected from configurations that include paraboloids, ellipsoids, spherical surfaces and frustrated cone surfaces. In the second preferred embodiment shown by FIGS. 3 and 4, the first surface area F10 shown has a configuration of a paraboloid, and the second and third surface areas F20 and F30, respectively, each have a configuration of a frustrated cone surface. The center of light emission 50' is coincident with the focal point of the first surface area F10; and the second and third surface areas F20 and F30, respectively, have no focal points.

In a first variation of the second preferred embodiment of the reflector lamp 1 of the present invention, the first surface area F1 has a configuration of a paraboloid. The second surface area F2 has a configuration of a frustrated cone surface, and the third surface area F3 has a configuration of an ellipsoid.

In a second variation of the second preferred embodiment of the reflector lamp 1, the first surface area F10 has a configuration of a paraboloid. The second surface area F20 has a configuration of an ellipsoid, and the third surface area F30 also a configuration of a frustrated cone surface.

In a manufactured test example in accordance with the second preferred embodiment of the reflector lamp 100, the reflector lamp 100 has a diameter of 111 mm. It also has a first surface area F10 having a configuration of a paraboloid, a second surface area F20 having a configuration of a frustrated cone surface, and a third surface area F30 also having a configuration of a frustrated cone surface. In this third variation, the depth of the reflector 30 is about 36.2 mm. The depth of the first surface area F10, measuring from its projected apex 130, is about 15 mm, the depth of its bordering second surface area F20 is between about 5 mm and 8 mm, and the depth of its bordering third surface area F30 is between about 13.2 and 16.2 mm. The center of light emission 50' of the discharge lamp 50 is about 17 mm from the projected apex 130 and is coincident with the focal point of the first surface area F10.

FIG. 4 indicates relative distances between elements along the longitudinal axis 40. The distance between the projected apex 130 and a proximate edge of the first surface area F10 is indicated by t10, the distance between a distal edge of the first surface area F10 and a distal edge of the second surface area F20 is indicated by t20, and the distance between a distal edge of the second surface area F20 and a distal edge of the third surface area F30 is indicated by t30. The combined distances t10, t20 and t30 is indicated by T.

In this case, the focal point of the first surface area F10 is located closer to the lens 200, that is, farther from the projected apex 130. The distance indicated by t10 is that between the projected apex 130 and a proximate end of the discharge chamber 70 and, coincidentally, a distal end of the first surface area F10. The second surface area F20 extends away from the first surface area F10 just beyond a distal end of the discharge chamber 70 of the discharge lamp 50, which is maximally 8 mm in length. In this embodiment, the second surface area F20 has a similar function to that of the first surface area F1 of the concave reflector 30 of the first embodiment.

In the variations of the second preferred embodiment of the reflector lamp 100, the even distribution of yellow light is further improved by providing the first and second surface areas F10 and F20, respectively, with spherical facets disposed in a honeycomb-like structure and by providing the third surface area F30 with one set of a set of flat spirals and a set of cylindrical facets.

FIG. 3 illustrates the areas covered by light arriving along illustrated paths 150, 160 and 170 and impinging on the surface 190 being illuminated. The longitudinal axis 40 of the reflector 30 intersects the surface 190 being illuminated at a point 40', which is the center of illumination. Predominantly yellow light radiating along paths 150 from the first surface area F10 is shown illuminating an area indicated in cross-section by end points i1, i1 and a center point m1, which is located at a distance indicated by e1 below the center of illumination point 40'. This illuminated area includes almost all of the area of the surface 190 being illuminated.

Predominantly yellow light radiating along paths 160 from the second surface area F20 is shown illuminating an area indicated in cross-section by end points i2, i2 and a center point m2, which is located at a distance indicated by e2 below the center of illumination point 40'. This illuminated area includes only the lower region of the surface 190 being illuminated.

Predominantly yellow light radiating along paths 170 from the third surface area F30 is shown illuminating an area indicated in cross-section by end points i3, i3 and a center point m3, which is located at a distance indicated by e3 above the center of illumination point 40'. This illuminated area includes only the upper region of the surface 190 being illuminated.

As indicated by FIG. 3, the surface defined within the end points i1, i1 covers a majority of the surfaces defined within the end points i2, i2 and i3, i3. Consequently, the total amount of light radiating along paths 150, 160 and 170 and along all other paths of light emitted by the reflector lamp 30 is evenly distributed over the surface 190 being illuminated. Thus color demixing, with an attendant yellow hot spot on the surface 190 being illuminated, is avoided.

It is emphasized that, within the frame of the present invention, additional surface area contours defined by rotating generatrices having a configuration of other selected conic section lines are possible.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

The invention claimed is:

1. A reflector lamp having a longitudinal axis, the reflector lamp comprising:

a concave reflector having a base disposed at one end;

a discharge lamp having a discharge chamber disposed on the longitudinal axis within the concave reflector, the discharge lamp having a fill comprising or forming salts which, in the heat of the discharge lamp, when the longitudinal axis is deviated from an upright position, and especially when the longitudinal axis is essentially in a horizontal position, at least partially condenses from a vapor phase to a liquid phase as a condensate at a colder, lower side of the discharge chamber;

the concave reflector having a reflective surface comprising at least two surface areas, a first surface area extending from the base, and a second surface area extending from the first surface area in a direction away from the base;

at least the first and second surface areas having different contours defined by a rotating generatrix having a configuration of a selected conic section line;

the contours of the surface areas and the disposition on the longitudinal axis of the center of light emission of the discharge lamp in relation to the surface areas are such that light from the discharge lamp passing through the condensate is distributed evenly over a surface being illuminated; and wherein the first surface area has a configuration of a paraboloid, and the second surface area has a configuration of an ellipsoid.

2. A reflector lamp having a longitudinal axis the reflector lamp comprising:

a concave reflector having a base disposed at one end;

a discharge lamp having a discharge chamber disposed on the longitudinal axis within the concave reflector, the discharge lamp having a fill comprising or forming salts which, in the heat of the discharge lamp when the longitudinal axis is deviated from an upright position, and especially when the longitudinal axis is essentially in a horizontal position, at least partially condenses from a vapor phase to a liquid phase as a condensate at a colder, lower side of the discharge chamber;

the concave reflector having a reflective surface comprising at least two surface areas, a first surface area extending from the base, and a second surface area extending from the first surface area in a direction away from the base;

at least the first and second surface areas having different contours defined by a rotating generatrix having a configuration of a selected conic section line the contours of the surface areas and the disposition on the longitudinal axis of the center of light emission of the discharge lamp in relation to the surface areas are such that light from the discharge lamp passing through the condensate is distributed evenly over a surface being illuminated; and wherein the first surface area has a configuration of a paraboloid and the second surface area has a configuration of a frustrated cone surface, the reflector lamp further comprising a third surface area extending from the second surface area in a direction away from the base and also having a configuration of a frustrated cone surface.

3. The reflector lamp as defined by claim 1, wherein the first surface area is provided with spherical facets disposed in a honeycomb-like structure.

4. The reflector lamp as defined by claim 1, wherein the second surface area is provided with one set of a set of flat spirals and a set of spherical facets.

5. The reflector lamp as defined by claim 1, wherein the center of light emission of the discharge lamp is located between the focal point of the first surface area and the base, and the focal point of the second surface area is located farther from the base than is the focal point of the first surface area.

6. The reflector lamp as defined by claim 1, wherein the focal point of the first surface area and the center of light emission of the discharge lamp are coincident, and the focal point of additional surface areas are located between the center of light emission and the end of the concave reflector opposite the end having the base.

7. The reflector lamp as defined by claim 1, wherein the reflector lamp has a diameter of 50 mm, the distance along the longitudinal axis of the reflector lamp between a projected apex of the first surface area and the distal limit of the first surface area is about 8.5 mm, the distance between the distal limit of the first surface area and the distal limit of the second surface area is about 19.5 mm, the distance between the projected apex and the distal limit of the second surface area is about 28 mm, the distance between the projected apex and the center of light emission of the discharge lamp is about 4.3 mm, and the distance between the projected apex and the focal point of the first surface area is about 5.8 mm.

8. The reflector lamp as defined by claim 1, wherein the first surface area has a configuration of a paraboloid and the second surface area has a configuration of a frustrated cone surface, the reflector lamp further comprising a third surface area extending from the second surface area in a direction away from the base and having a configuration of an ellipsoid.

9. The reflector lamp as defined by claim 1, wherein the first surface area has a configuration of a paraboloid and the second surface area has a configuration of a ellipsoid, the reflector lamp further comprising a third surface area extending from the second surface area in a direction away from the base and having a configuration of a frustrated cone surface.

10. The reflector lamp as defined by claim 2, wherein the reflector lamp has a diameter of 111 mm, the distance along the longitudinal axis of the reflector lamp between a projected apex of the first surface area and the distal limit of the first surface area is about 15 mm, the distance between the distal limit of the first surface area and the distal limit of the second surface area is within a range between 5 and 8 mm, the distance between the distal limit of the second surface area and the distal limit of the third surface area is within a range between 13.2 and 16.2 mm, the distance between the projected apex and the center of light emission of the discharge lamp is about 17 mm, the center of light emission being coincident with the focal point of the first surface area, and the distance between the projected apex and the distal limit of the third surface area is about 36.2 mm.

11. The reflector lamp as defined by claim 2, wherein each of the first and second surface areas is provided with spherical facets disposed in a honeycomb-like structure, the reflector lamp further comprising a third surface area extending from the second surface area in a direction away from the base and being provided with one set of a set of flat spirals and a set of cylindrical facets.

12. The reflector lamp as defined by claim 1, wherein the distance along the longitudinal axis of the reflector lamp between a projected apex of the first surface area and the distal limit of the first surface area is about 125 percent of the maximum longitudinal dimension of the discharge chamber of the discharge lamp.

13. The reflector lamp as defined by claim 1, wherein the center of light emission of the discharge lamp is arranged at a distance of about 4.3 mm from a projected apex of the first surface area, the length of the discharge chamber of the discharge lamp is about 8 mm, and the distance along the longitudinal axis of the reflector lamp between the projected apex and the distal limit of the first surface area is about 8.3 mm.

14. The reflector lamp as defined by claim 2, further comprising a lens disposed at the end of the concave reflector opposite the end having the base, wherein the focal point of the first surface area is located very close to the lens, the first surface area extending in the direction of the longitudinal axis from a limit proximate a projected apex of the first surface area to a distal limit that coincides with a point inside the discharge chamber that is closest to the base, the second surface area extending from the first surface area in a direction toward the lens, the longitudinal dimension of the second surface area being equal to about 125 percent of the longitudinal dimension of the discharge chamber.

* * * * *

UNITED STATES PATENT AND TRADEMARK OFFICE

CERTIFICATE OF CORRECTION

PATENT NO. : 7,517,115 B2
APPLICATION NO. : 11/226851
DATED : April 14, 2009
INVENTOR(S) : Gunther Van De Poel It is certified that error appears in the above-identified patent and that said Letters Patent is hereby corrected as shown below:

Column 8, Line 1, Claim 6:

Delete "claim 1" and insert -- claim 2 --.

Signed and Sealed this

Twenty-first Day of July, 2009

John Doll

JOHN DOLL
*Acting Director of the United States Patent and Trademark Office*